United States Patent [19]

Maddock et al.

[11] Patent Number: 4,678,153

[45] Date of Patent: Jul. 7, 1987

[54] TROUBLE LAMP AND RETAINER

[75] Inventors: William H. Maddock, Markham; Bert Bobrovniczky, Don Mills, both of Canada

[73] Assignee: Noma Inc., Scarborough, Canada

[21] Appl. No.: 795,008

[22] Filed: Nov. 4, 1985

[51] Int. Cl.[4] ..... A47B 96/06

[52] U.S. Cl. ..... 248/229; 249/316.7; 362/396; 24/339

[58] Field of Search ..... 248/229, 73, 74.2, 231.8, 248/316.7; 362/376, 396; 24/545, 339

[56] References Cited

U.S. PATENT DOCUMENTS

| | | | |
|---|---|---|---|
| 768,161 | 8/1904 | Thompson | 81/426.5 X |
| 1,479,739 | 1/1924 | Radtke | 362/396 X |
| 1,574,695 | 2/1926 | Riley | 362/396 X |
| 1,684,347 | 9/1928 | Dobbs | 248/229 |
| 2,569,068 | 9/1951 | Maxwell | 240/54 |
| 2,727,137 | 12/1955 | Oharenko | 240/90 |
| 3,154,281 | 10/1964 | Frank | 248/74.2 X |
| 3,872,428 | 3/1975 | Boisvert | 240/52.1 |
| 4,211,380 | 7/1980 | Lillegard et al. | 248/229 |
| 4,288,848 | 9/1981 | Fido | 362/378 |
| 4,528,622 | 7/1985 | Bacevius | 362/396 |

FOREIGN PATENT DOCUMENTS 387740 of 1908 France ..... 81/426.5

OTHER PUBLICATIONS

Noma Canada Inc. Clamp Lamp brochurer published 1981.

*Primary Examiner*—Ramon S. Britts
*Assistant Examiner*—Blair M. Johnson
*Attorney, Agent, or Firm*—Kenneth M. Garrett

[57] ABSTRACT

A retainer for a trouble lamp having an elongated handle comprises a holder including a pair of spaced apart jaws connected at one axial end thereof by a bight portion. The jaws are configured to provide a first pair of axially aligned bearing surfaces and a second pair of transversely aligned bearing surfaces communicating with the first pair of bearing surfaces for receiving the handle of the trouble lamp therebetween in either an axially aligned or a traversely aligned position. A journal connects the bight of the holder to a clamp member for relative axial rotation therewith.

14 Claims, 6 Drawing Figures

TROUBLE LAMP AND RETAINER

FIELD OF INVENTION

This invention relates to improvements in trouble lamps. It particularly relates to a retainer therefor which may be combined therewith to more readily permit the trouble lamp to be retained in position adjacent to a work area and oriented for maximum effectiveness.

BACKGROUND OF INVENTION

Trouble lamps have long been sold as articles of commerce. Generally such lamps are provided at one end with a handle and at the other with a hook whereby they may be hooked into a position close to a work or inspection site. However, this is often less than satisfactory in providing a suitable means for orienting the lamp for maximum effectiveness.

Various proposals have been put forward for providing retainers by which portable lights may be mounted from a convenient support so as to be easily oriented to direct light to a desired location. Among these may be instanced U.S. Pat. No. 2,569,068 (Maxwell); U.S. Pat. No. 3,872,428 (Boisvert) and U.S. Pat. No. 4,288,848 (Fido). In each of these proposals there was provided a retainer comprising a clamp arrangement and an interconnection between the clamp and the body of the lamp to permit the lamp to be moved relative to the clamp. Such interconnection involved the re-structuring of the trouble lamp, whereby the arrangement was not suited for retrofitting to existing lamps. Moreover, in such proposals the retainer was not captured on the lamp, so that the retainer might be misplaced if disconnected from the lamp.

It is an object of this invention to provide an adjustable retainer for trouble lamps.

It is another object of the invention to provide a retainer of the aforementioned type that permits the ready orientation of a trouble lamp.

It is yet another object of the invention to provide an adjustable retainer which requires no modification of a standard trouble lamp.

It is a further object of the invention to provide a retainer and trouble light combination which may be converted without use of tools or the risk of losing parts to permit the trouble lamp to be hand held, or used with the retainer.

SUMMARY OF THE INVENTION

In accordance with one aspect of the invention, a retainer for a trouble lamp which includes an axially elongated handle therefor comprises a holder for releasably grasping the handle in either of two orthogonally intersecting positions. In at least one of the positions the handle is rotatable about its axis with respect to the holder. The retainer further comprises a clamp member, and a journal connecting the holder to the clamp, whereby the clamp is rotatable on the journal with respect to the holder.

Preferably the journal is tubular, so as to provide a passage for the cord of the trouble lamp to the interior of the holder, thereby capturing the retainer on the cord of the trouble lamp. Additionally, the passage of the cord to the interior of the holder facilitates the retention of the trouble lamp in the holder in an axially aligned position.

DESCRIPTION OF THE PREFERRED EMBODIMENT

Figure 1:
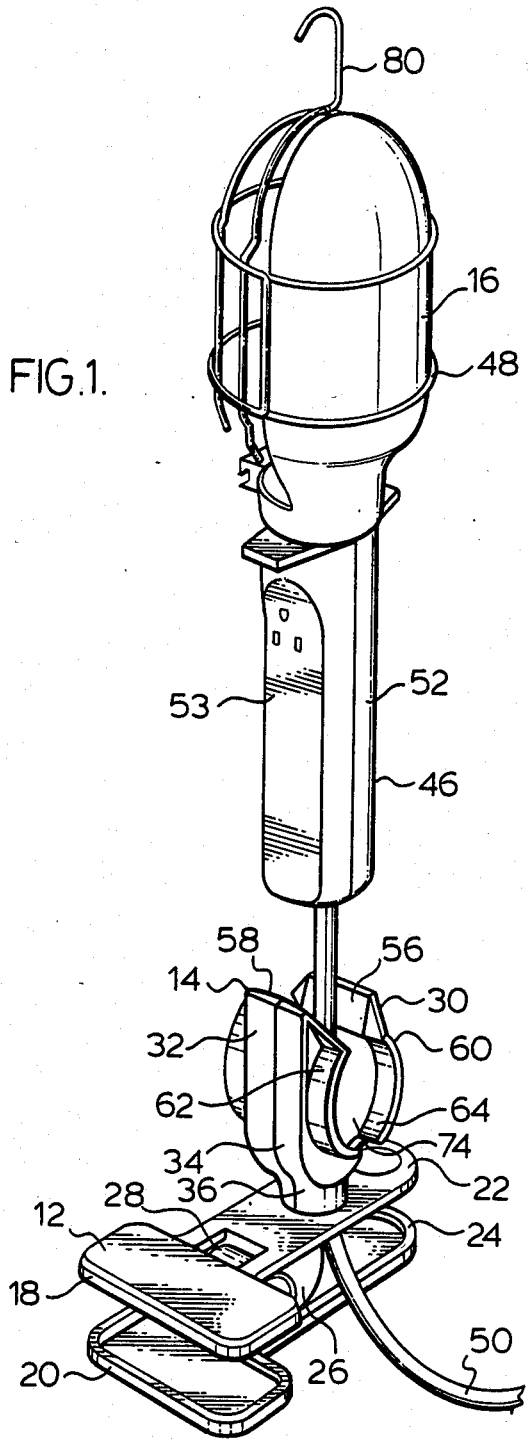
FIG. 1 shows in perspective view a trouble lamp retainer with a trouble lamp positioned for axial engagement in the retainer.
Figure 2:
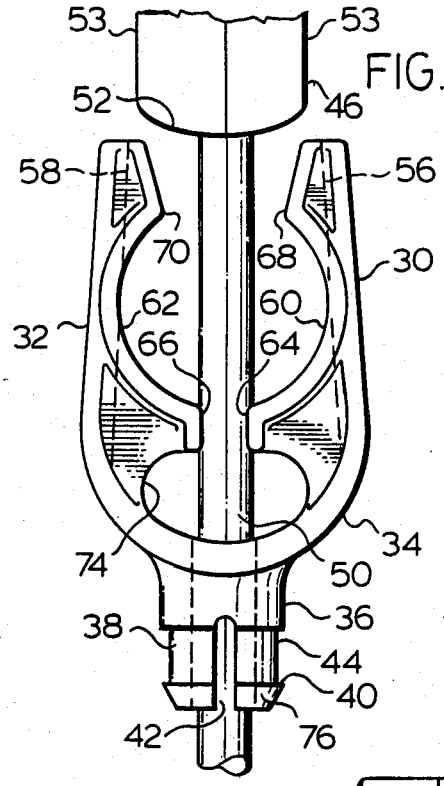
FIG. 2 shows the holder portion of the retainer on enlarged scale in front elevation, with the trouble lamp positioned for transverse engagement therewith.
Figure 3:
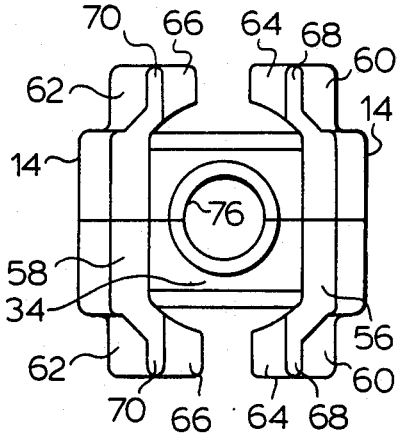
FIG. 3 shows the holder in plan view from above.
Figure 4:
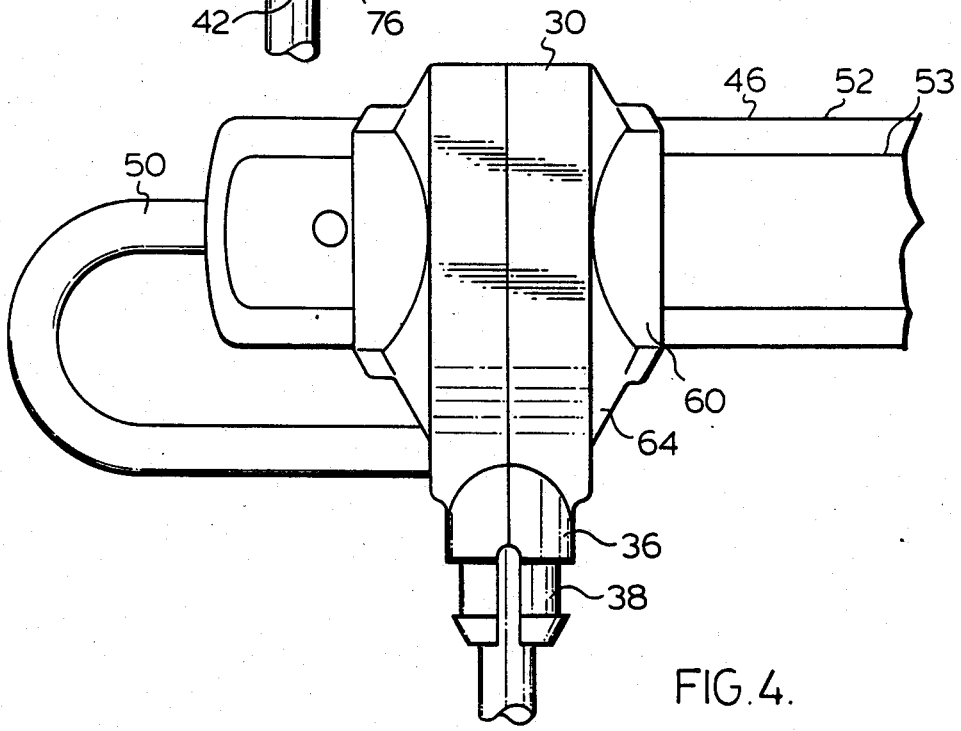
FIG. 4 is a side elevational view of the holder with the handle of the trouble lamp grasped therein in its transverse position.

Referring to the drawings in detail, a combination trouble light and retainer in accordance with the invention comprises a pincher type clamp 12, a holder 14 and a trouble lamp 16. Clamp 12 includes first and second pincher plates 18, 20 having rearwardly projecting grasping portions 22, 24 pivotally connected at centreless bearings 26 and urged closed by a C spring 28.

Holder 14 comprises first and second spaced apart jaws 30, 32 interconnected at their lower ends by a bight 34. A tubular post 36 projects downwardly from bight 34, post 36 terminating in a tapered spigot 38 having a retaining shoulder 40 therearound. Spigot 38 is provided with a plurality of axial slots 42. The grasping portion 22 of clamp 12 is formed with a frustrated conical aperture 44 therethrough, to form a bearing for spigot 38. The conical angle of the aperture 44 is marginally greater than that of spigot 38 above shoulder 40, the diameter of the aperture adjacent the lower periphery being marginally less than the diameter of the spigot 38 immediately above shoulder 40. Accordingly, when shoulder 40 is snappd behind the lower wall surface of grasping portion 22, portions of spigot 38 are resiliently, inwardly deformed intermediate a point P and shoulder 40. This deformation ensures a tight interference fit between spigot 38 and its bearing; also it generates an upwardly directed reactive force on the spigot, so as to increase the contact pressure between shoulder 40 and the lower wall surface of grasping portion 22. Accordingly, holder 14 will retain any set position with respect to clamp 12 until urged manually to a new position.

Trouble lamp 16 is of a conventional type and comprises an axially elongated handle 46, a lamp assembly 48 secured thereto adjacent one end thereof and an electrical power cord 50 which enters the handle coaxially at the opposite end and which is operatively connected to the electrical components of lamp assembly 48 in known manner. Handle 46 of the trouble lamp 16 has a uniform, barrel shaped transverse cross section along a substantial part of its length, including the end thereof adjacent the entry of cord 50. The arcuate sides 52 of handle 46 reside on a common circular locus, and the flat sides are denoted by the numeral 54.

The jaws 30,32 of holder 14 have in transverse cross section an interior wall surface which forms an open sided socket bearing 54 for the handle 46 of trouble lamp 16. Considering holder 14 in transverse cross section, the dimension of the interior surface of flat medial portions 56,58 of each of jaws 30,32 is generally coextensive with the lateral width of flats 53 of handle 46. Wings 60,62 are provided on each lateral side of medial portions 56,58; in lateral cross section the interior surfaces of the wings are of complementary form to the arcuate sides 52 of handle 46 but they are spaced apart by somewhat less than one diameter. Wings 60,62 at their lower extremities 64,66 are spaced apart by a distance somewhat less than to the diameter of power cord 50. At their upper extremities 68,70 wings 60,62 are spaced apart by a distance somewhat less than the dimension between opposed flats 54 of handle 46, to permit the passage of the handle therebetween when transversely positioned.

In axial cross section, the internal surfaces of wings 60,62 are formed on a circular locus having a radius equal to that of the arcuate sides 52 of handle 46, thereby forming an open sided, open ended tubular bearing 72 for the handle 46 of the trouble lamp, bearing 72 connecting with bearing 54. Holder 14 is provided with a passageway 74 beneath bearings 72 but connecting thereto, the passageway 74 and bearing 72 being separated by the restriction created by wing portions 64,66.

Power cord 50 of trouble lamp 16 is threaded through the bore 76 of spigot 38, thereby passing to the interior of holder 14, and securing the holder and clamp therewith captive on the power cord, so that when the holder is not engaged with the handle 46 of trouble lamp 16, the retainer will not become misplaced.

The jaws 30,32 of holder 14 are constructed so as to be upwardly, inwardly inclined, whereby the spacing between the interior medial portions 56,58 at the upper extremity of the jaws is somewhat less than the dimension between opposed flats 54 of handle 46. The jaws 30,32 are thus resiliently urged apart as handle 46 is forced therebetween in the axial direction, so as to grip the handle firmly in the socket bearing 54 formed by medial portions 56,58 and wings 60,62. Wings 60,62 assist in preventing the accidental lateral displacement of handle 46 from the jaws of holder 14 when trouble lamp 16 is held vertically in the holder; power cord 50 also assists in preventing such lateral displacement. In the event that it is wished to direct light from lamp 48 in a particular direction with the trouble lamp arranged vertically in holder 14, the holder is rotated as a whole about the axis of spigot 38.

In the event that it is desired to arrange the trouble lamp 16 transversely in holder 14, the trouble lamp is axially withdrawn from the holder by a distance somewhat greater than the axial length of the handle. Power cord 50 is then urged between the lower extremities 64,66 of the wings at one lateral side of the holder so as to trap it in passageway 74. Handle 46 of the trouble lamp is inclined to the transverse position and urged between jaws 30,32, until the handle enters and is firmly seated in split tubular bearing 72. In this seated position, jaws 30, 32 are resiliently sprung apart to grip the handle 46 quite firmly, it may be rotated about the axis of the handle to direct the light from lamp assembly 48 as required. The holder 14 and the trouble lamp 16 therewith may additionally be rotated about the axis of spigot 38.

The spacing between the lower extremities 64, 66 of the wings is arranged to be marginally less than the diameter of power cord 50 when the handle 46 is seated in bearing 72, whereby power cord 50 remains trapped in passageway 74. It may be remarked that passageway 74 has a transverse dimension that is several times greater than the diameter of power cord 50. This increased size assists in permitting power cord 50 to be easily pulled through the passageway. More importantly, however, it weakens jaws 30, 32 adjacent the juncture thereof with bight 34 to define spaced apart roots about which the jaws will resiliently spring apart, whereby handle 46 may be gripped more or less uniformly along the length of an axially engaged portion when axially positioned in holder 14, or about its engaged periphery when transversely oriented in the holder.

Figure 5:
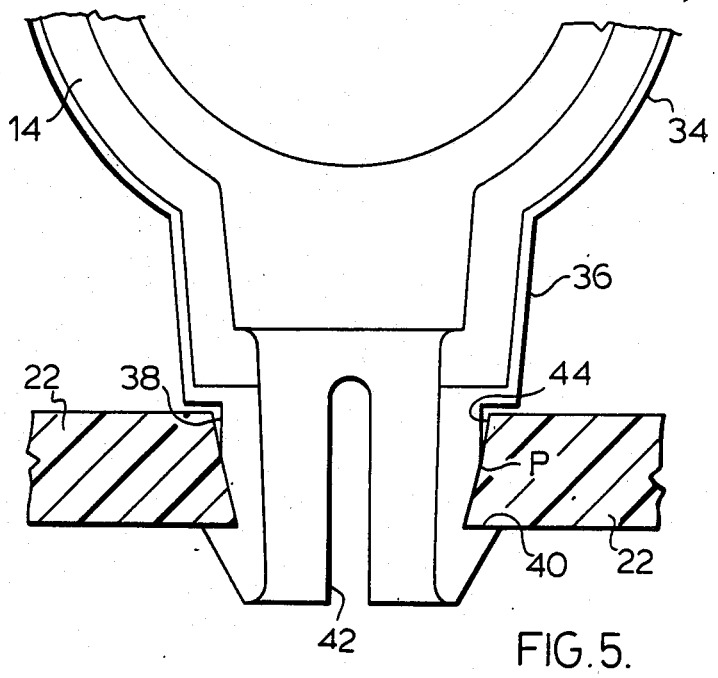
FIG. 5 is a fragmentary sectional elevational view showing the method of retaining the holder on the clamp.
Figure 6:
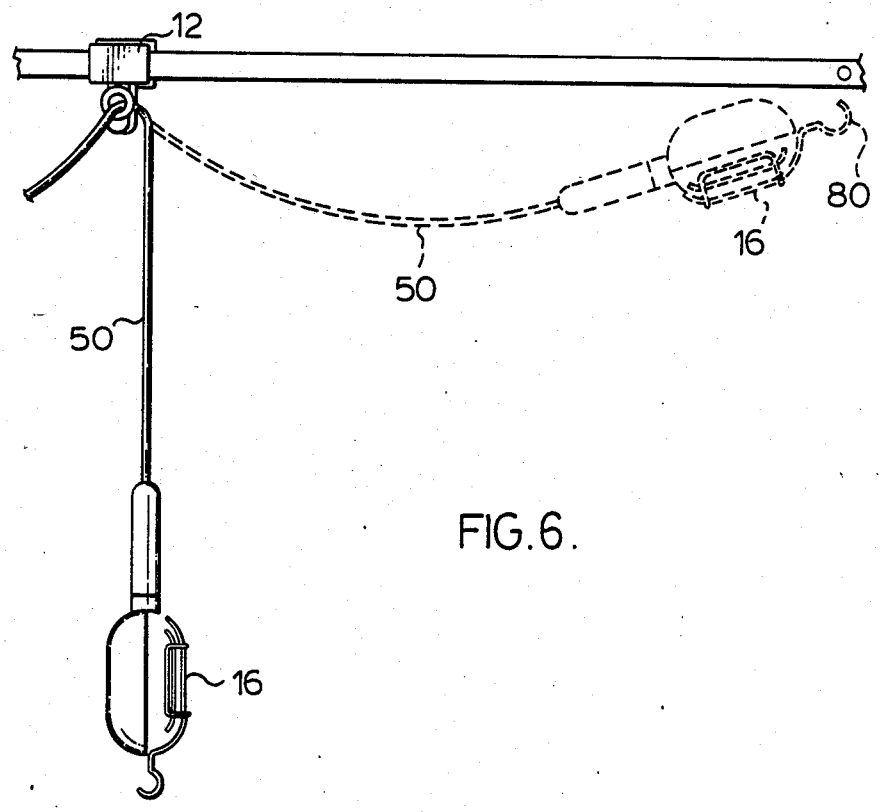
FIG. 6 is a sketch showing a manner of use of the trouble lamp-retainer combination, and in dashed outline an alternative manner.

The handle 46 of trouble lamp 16 may be disengaged completely from holder 14, so as to permit traditional hand-held use of the trouble lamp. In this mode of operation the holder and clamp will of course be retained captive on power cord 50. When the clamp locates on power cord 50 remote from handle 46, it may be used to suspend the trouble lamp from a convenient support S, as suggested by FIG. 5, or to maintain the power cord 50 away from a work area, as suggested in dashed outline in the same Figure. Other uses of the trouble lamp and retainer combination will undoubtedly occur to other persons.

The foregoing embodiment is illustrative only of the instant invention. Undoubtedly other embodiments thereof will be suggested by the foregoing disclosure which according to particular circumstances may possibly be preferred, and it is intended that all changes be encompassed within the spirit of the accompanying claims.

We claim:

1. A retainer for a trouble lamp having an elongated handle comprising:

a holder including a pair of spaced apart elongated jaws extending about a first central axis and connected at one axial end thereof by a bight portion, said jaws defining a first pair of opposed axially aligned substantially concave bearing surfaces and a second pair of transversely aligned opposed substantially concave bearing surfaces located about a second central axis extending transverse to and intersecting said first central axis intermediate the axial ends thereof for receiving and retaining the handle of said trouble lamp therebetween in either an axially aligned or a traversely aligned position, and;

a clamp member;

one of said clamp member and the bight portion of said holder being provided with a journal and the other a bearing for said journal to thereby connect said clamp member and said holder for relative axial rotation.

2. A retainer as defined in claim 1, wherein said journal is tubular to provide a passage to the interior of said holder.

3. A retainer as defined in claim 1, wherein said clamp is a pincher type.

4. A retainer as defined in claim 1, 2 or 3, wherein said transversely aligned bearing surfaces reside on a circular locus.

5. A retainer as defined in claim 1, 2 or 3, wherein medial portions of said axially aligned bearing surfaces are planar.

6. A retainer as defined in claim 1, 2 or 3, wherein medial portions of said axially aligned bearing surfaces are planar, and further including wing portions which project therefrom on a circular locus.

7. A retainer as defined in claim 1, 2 or 3, wherein said journal and the bearing thereof are formed with differently tapered mating surfaces so as to provide a tight interference fit on said journal when seated in said journal bearing.

8. In combination a trouble light having an axially elongated handle with a lamp assembly mounted from one end thereof and a power cord entering said handle coaxially therewith at the other end thereof, operatively connected to said lamp assembly;

a holder for said handle, said holder comprising a pair of elongated upstanding facing, spaced apart jaws connected at the lower axial end thereof by a bight;

said jaws defining an axially and substantially concave aligned bearing for said handle and a transverse and substantially concave bearing communicating with said axially aligned bearing intermediate the axial ends thereof;

a clamp member;

a transversely aligned cord passageway located beneath said transverse bearing and communicating therewith, and a spigot rotatably interconnecting said clamp member and said bight portion to provide a conduit communicating with said bearings, said power cord being threaded through said conduit.

9. The combination of claim 8, wherein said handle has a uniform cross-section along a substantial part of its length.

10. The combination of claim 9, wherein said cross-section comprises a first pair of flat parallel sides interconnected by a second pair of sides residing on a common circular perimeter.

11. The combination of claim 10, wherein the bearing surfaces of said facing jaws forming said transverse bearing are in axial cross-section circular arcs having a radius equal to that of the second pair of handle sides.

12. The combination of claim 11, wherein said bearing surfaces of said transverse bearing are spaced apart by less than twice the radius of said circular arcs, taken on a line passing through the origin of the arcs.

13. The combination of claim 10, wherein the bearing surfaces of said jaws forming said axially aligned bearing comprise a generally planar medial portion and arcuate wing portions on each side of the planar position.

14. The combination of claim 8, wherein said jaws where said passageway communicates with said transverse bearing approach each other by a dimension less than the diameter of said power cord, to form a trap for said power cord.

* * * * *